US005231796A

United States Patent [19]

Sims

[11] Patent Number: 5,231,796

[45] Date of Patent: * Aug. 3, 1993

[54] INTEGRATED PEST CONTROL SYSTEM

[75] Inventor: Gregory A. Sims, Winter Springs, Fla.

[73] Assignee: Environmental Safety Systems, Inc., Melbourne, Fla.

[ * ] Notice: The portion of the term of this patent subsequent to Jul. 31, 2007 has been disclaimed.

[21] Appl. No.: 519,506

[22] Filed: May 7, 1990

Related U.S. Application Data

[62] Division of Ser. No. 242,041, Sep. 8, 1988, Pat. No. 4,944,110.

[51] Int. Cl.[5] ..... A01M 7/00

[52] U.S. Cl. ..... 43/124

[58] Field of Search ..... 137/360, 594; 239/561, 239/547; 47/48.5; 43/124, 132.1, 138, 137, 136, 135

[56] References Cited

U.S. PATENT DOCUMENTS 3,782,026 1/1974 Bridges ..... 43/124

4,210,286 7/1980 Smitherman ..... 239/557

*Primary Examiner*—Mark Rosenbaum

*Assistant Examiner*—James Miner

*Attorney, Agent, or Firm*—Robert W. Duckworth

[57] ABSTRACT

An integrated pesticide applicating system utilizes lengths of small diameter closed end flexible tubing with periodically spaced perforations having open ends terminating at junction boxes which are serviced on a periodic basis by certified pest control technicians utilizing expanding chemicals that are administered in measured quantities to provide a residual pest control block in concealed areas of a building. Externally mounted junction boxes provide a pest control method in which the chemicals can be applied without the necessity of access to the interior of the building by the servicing technician. Tubing perforations are preferably conically shaped.

2 Claims, 3 Drawing Sheets

INTEGRATED PEST CONTROL SYSTEM

This is a division of application Ser. No. 07/242,041 filed Sep. 8, 1988, now U.S. Pat. No. 4,944,110.

The invention relates to a built-in pest control system for the distribution and release of pesticide within walls and other concealed areas of buildings.

BACKGROUND OF THE INVENTION

The control of bugs, rodents and other pests within buildings is usually done by spraying or depositing pesticides along baseboards and other exposed areas or by spraying the same into those concealed areas readily accessible through cracks and crevices. Such application of poisonous substances presents a hazardous potential for harmful contact with humans and pets, either directly or through the intermediary of contacted foodstuffs or utensils. Those substances may also leave unsightly stains on carpets and baseboards. Furthermore, the residual effectiveness of pesticides thus applied may be reduced by exposure to the degenerating effects of UV light and moisture.

Commercially available pest control products for crack and crevice application, include aerosols such as those available from Whitmire Research Laborabories, St. Louis, MO, designed for direct injection into wall voids and other concealed places through expansion joints, electrical outlet openings and the like, using short lengths of tubing that affix to the spray nozzle of the can. Crack and crevice injection chemicals can be stronger and, thus, more effective than exposed surface application materials; however, care must be taken to avoid depositing the same onto exposed surfaces or introducing the more potent material into the air. Moreover, there is a danger that the stronger materials may be used by nonprofessionals as contact sprays for exposed surface treatment, contrary to directions and despite nonapproval for such usage.

Ramsey U.S. Pat. No. 3,676,949 proposes an insecticide distribution system in which insecticide is introduced under pressure into piping preinstalled through the studs, joists, rafters and built-ins of buildings, and released through preset pressure responsive nozzles, each positioned to spray a different otherwise inaccessible interior building location. Installation of piping is preferably to be done during building construction. The pipes are run in circular loops, having a return line back to the point of entry. Insecticide is run under pressure into the entry port, with the exit port closed off. Pressure is built up in the pipe, until the pressure has built up to the release pressure of each valve. The valves then open, and insecticide is sprayed into the wall void or other concealed location of the valve. Once the material has been completely distributed throughout the house, the piping lines are cleaned out by forcing air or a combination of air and solvent through the piping.

While Ramsey recognizes the benefit of distributing and releasing pest control materials by means of a conduit system to areas that would otherwise be inaccessible following completion of construction, the rigidity of the piping utilized, the return loop requirement needed for prerelease pressurizing, and the use of individual pressure valves provides an unnecessary complexity to the system that presents a burden both during and after installation. The valves ("nozzles") are, for example, mounted in place by drilling and tapping after installation of the piping itself. This procedure takes time, costs money, and interferes with the construction schedule. Moreover, the nozzles have moving parts that may block in either open or closed position, both of which will interfere with proper operation, but will be difficult to remedy because of subsequent inaccessibility. Also, it will be difficult to know which of the concealed nozzles is the offending one.

Lundwall U.S. Pat. No. 4,028,841 relates to a distribution system for vermin control, also facilitated by the use of pipes disposed throughout a building. The Lundwall system employs pipes having periodic openings for distribution of a fluid vermin control material throughout the walls and below ground level. Distribution is effected by means of a pressurizing pump controlled by a solenoid valve, which automatically and periodically pumps material from a storage reservoir under pressure through the openings. Lundwall recommends the use of chlordane, a highly toxic material having a long residual life. The Lundwall approach requires considerable equipment to be located in an attic or elsewhere in the building in order to operate the system.

The present invention overcomes the above and other drawbacks of the prior art by providing an improved integrated pest control system that utilizes equipment that can be easily installed and maintained, with little or no interruption in building construction scheduling and without the need for concealed moving parts or the requirement for cumbersome dispersing control machinery.

SUMMARY OF THE INVENTION

In accordance with one aspect of the present invention an integrated pesticide applicating system is provided which utilizes lengths of small diameter flexible plastic tubing formed with tiny discharge orifices at periodic intervals. The tubing is installed in wall voids, suspended ceilings and similar hollow spaces of buildings and has an end that terminates at a wall receptacle which serves as an access port for the injection of pesticide material. The tubing length and diameter, hole size, and pesticide application parameters are chosen to provide a predetermined approved measured amount of chemical coverage for the desired pest control coverage.

A preferred system has tubing installed horizontally through the studs within every interior and exterior wall, and placed laterally at regular intervals within false ceiling spaces. Additionally, other installations are optionally made behind and under the fixtures, equipment, food pantries and applicances in food preparation areas; within the pony walls, booths and serving counters of dining areas; and behind and under the showers, tubs and cabinets in restroom facilities. A preferred spacing for discharge orifices is every 12" along suggested 40 to 60 foot lengths of tubing. The system is preferably serviced on a regular basis by a certified pest control technician who injects metered amounts of an expanding pesticide propellant into the port/receptacles. The perforations are advantageously shaped to converge conically outward so that the propellant can expand hundreds of times its original mass as it flows out the discharge orifices and completely fills the cracks, crevices, hollow spaces and voids where pests live, hide and breed.

The system and method of application of the invention forms a "behind the scenes" network deep within a structure to maintain a building free and clear of pests. Timing of the pesticide injection ensures correct, approved application in predetermined amounts. The pesticide is contained within the wall cavities, thereby minimizing exposure to ultraviolet light and contact with people and animals or their immediate surroundings. In a preferred method of application, after injecting the pesticide, cleansing is performed by injecting an inert gas, such as nitrogen, into the tubing to expel chemical residue left in the system and to clear the orifices to prepare for the next injection.

In an advantageous installation, described below, lengths of tubing establish pesticide distribution zones throughout the house and are terminalled at externally mounted injection receptacles which can be accessed by a pest control technician without the need for entry into the building itself.

The simplicity of the tubing and the receptacle mounting arrangements provides for ease of installation, with little or no delay in construction schedules and with little requirement for maintenance.

BRIEF DESCRIPTION OF THE DRAWINGS

Embodiments of the invention have been chosen for purposes of illustration and description, and are shown in the accompanying drawings, wherein.

Throughout the drawings, like elements are referred to by like numerals.

DETAILED DESCRIPTION OF PREFERRED EMBODIMENTS

Implementation of the principles of the invention is illustrated in its application to embodiments of an integrated pesticide applicating system illustrated in FIGS. 1–6.

Figure 1:
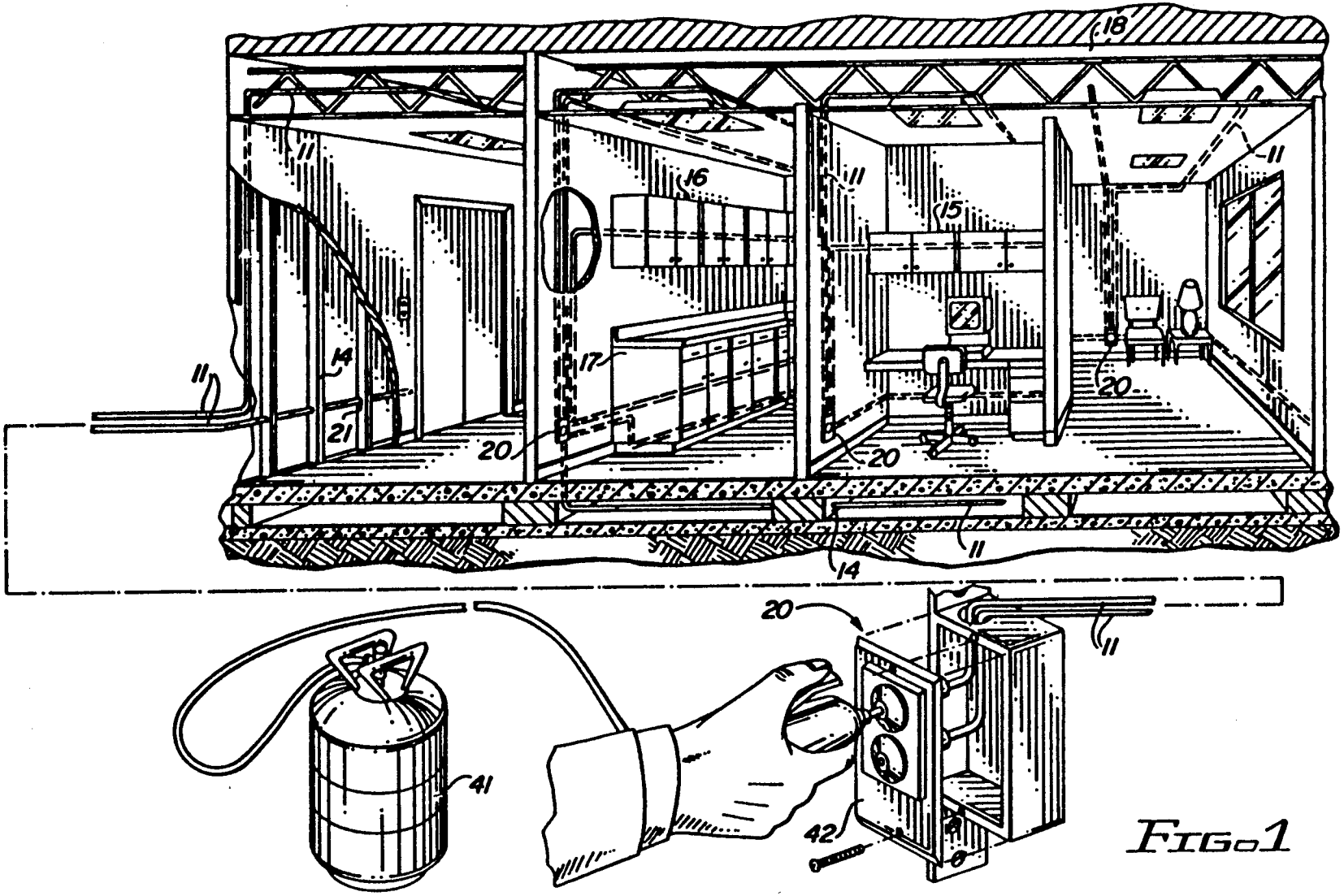
FIG. 1 is a partially schematic view showing an installation and operation of a system in accordance with the invention.
Figure 2:
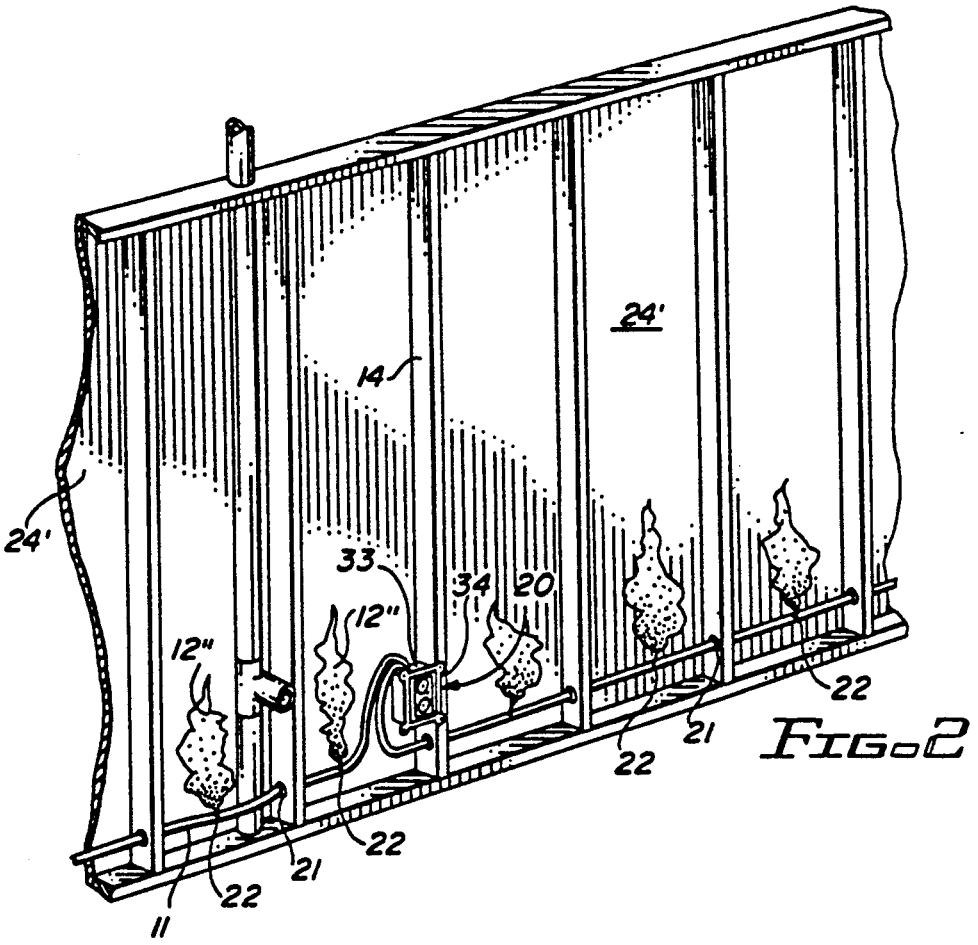
FIG. 2 shows installation of tubing and operation of the system of FIG. 1, in a wall of a building.

With reference to FIGS. 1 and 2, preferably at the time of building construction, flexible conduit 11 is run horizontally 6 to 8 inches up from the base plate 12 through studs 14 of interior and exterior walls of a building and through other confined spaces, such as behind the partitions of built-in bookcases 15 and storage cabinets 16, 17. The conduit 11 is also run within false ceiling spaces 18 and, where applicable, throughout crawlways 19.

The preferred conduit comprises small diameter polyethylene tubing (0.125 inch OD and 0.065 inch ID) installed in 40 to 60 foot lengths, terminating at exterior or interior port receptacles 20. The tubing (viz. ⅛ inch tubing) is run through the studs by drilling holes 21 (viz. ¼ inch holes) horizontally through the studs parallel to the plane of the wall (FIG. 2). Similar passage is made through other structural members.

The tubing 11 is preferably of the flexible, extruded type available commercially as, for example, from Union Carbide Linear Low-Density Polyethylene extrusion compound that exhibits good environmental stress cracking resistance and good extrusion characteristics. The tubing is advantageously also formed with a UV resistant material to maintain its flexibility prior to and throughout installation. The tubing 11 is provided with periodic apertures or perforations 22 which serve as outlet ports for the emission into concealed building areas of pesticide in a manner described below.

The perforations 22 are preferably spaced every 12 inches, to ensure that at least one perforation 22 will be located in each wall void 24 for standard stud spacings of 16 or 24 inches center-to-center. Other spacings are, of course, possible. However greater spacings, e.g. every 15 inches, can lead to two perforations in one wall void 24 and no perforations in an adjacent wall void 24' (see FIG. 2). Smaller spacing, e.g. 6 inches or 8 inches, will give the desired at least one perforation per wall void but will result in a decrease in pressure along the tubing length for expulsion of the pesticide material.

Figure 3:
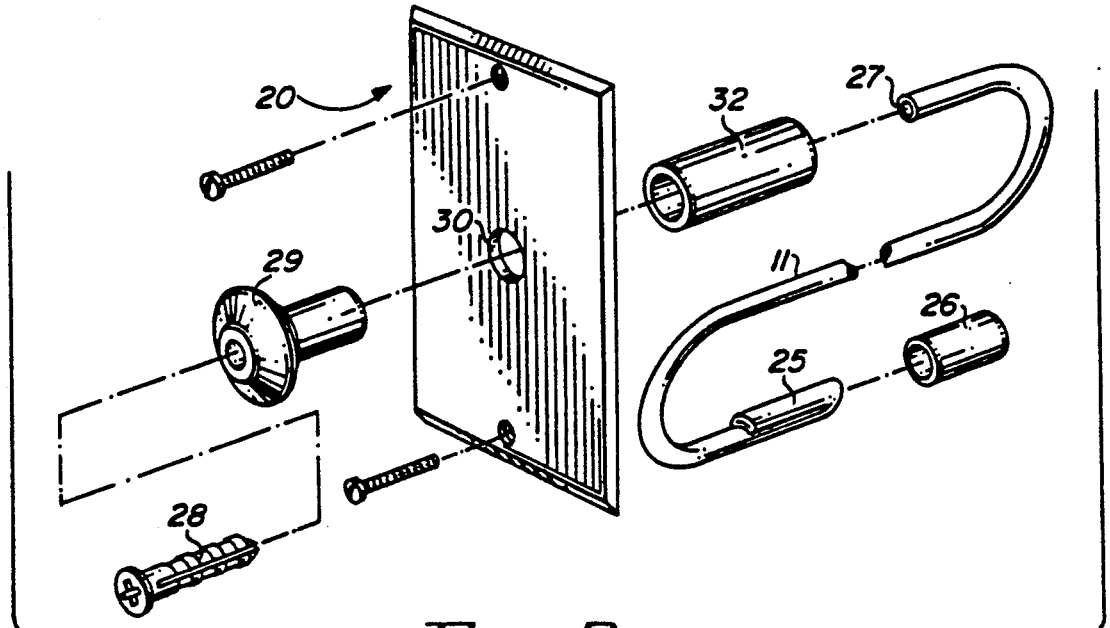
FIG. 3 is an exploded view showing installation of a length of tubing to a single terminal receptacle.

One end of each tubing length is closed, as shown in FIG. 3, the other open end is connected to a receptacle 20. This may be accomplished simply, as shown, utilizing conventionally available materials. The ⅛ inch diameter tubing can, for example, be doubled over to form the closed end 25 and a sleeve in the form of a short length of ¼ inch standard drip irrigation tube 26 is then slipped over to secure the same. The other end 27 is then mounted in an accessible manner to receptacle 20. The end 27 may, for example, be brought into the serrated wall-inserted expanding end of a ¼ inch plastic anchor 28 which is inserted coaxially into a standard ¼ inch cable bushing 29 positioned within an opening 30 of a standard TV cable wall mounting plate 31. The interior portion of the bushing 29 is maintained in place by sliding a short length of ⅜ inch drip irrigation tubing 32 over the outside diameter of the bushing 29. The plate 31 is mounted after the (FIG. 1) wall is finished onto a standard electrical box 33 which, for external walls, can be provided with a ½ inch mud ring or other waterproofing mechanism 34 (FIG. 2).

Figure 4:
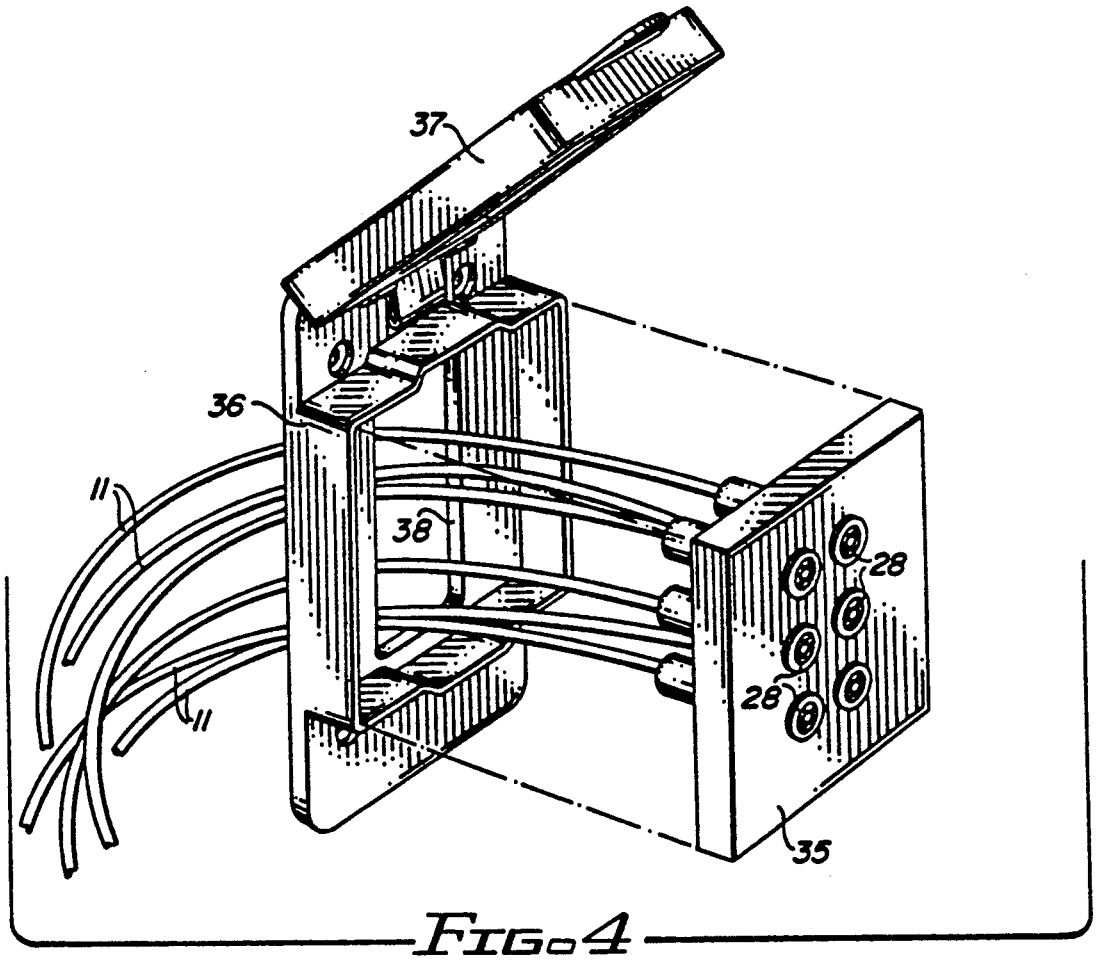
FIG. 4 is an exploded view of a multi-terminal receptacle.

FIG. 3 shows a simple version of receptacle 20 for mounting the open end 27 of a single length of tubing 11. However, as illustrated in FIGS. 1 and 4, multiple terminal receptacles can also be provided. FIG. 1 shows the use of a plurality of zones of coverage, the open ends 27 of each tubing length 11 providing coverage in that zone terminating at a single receptacle 20.

FIG. 4 shows the use of a special box for access from the exterior of a building to internally located tubing lengths by a certified pest control technician or other supplier of pesticide. As shown, a plurality of tubing lengths 11 terminate at anchors 28 mounted in openings of a plastic plate 35. The plate is dimensioned to snuggly fit within the protected recess of an outdoor electrical outlet box 36 with the lengths 11 passing through a central opening 38 therein. The box 36 includes a spring-loaded cover 37 which, when opened, permits access to the ends 27 of the several tube lengths 11 and, when closed, shields the same from the weather. The mounting of one or more boxes 36 on the building exterior permits injection of pesticide into various zones of coverage, without the need for the person applying the chemicals to gain entrance to the interior of the structure. A lock (not shown) may optionally be provided on the box 36 to prevent unauthorized use thereof.

Figure 5:
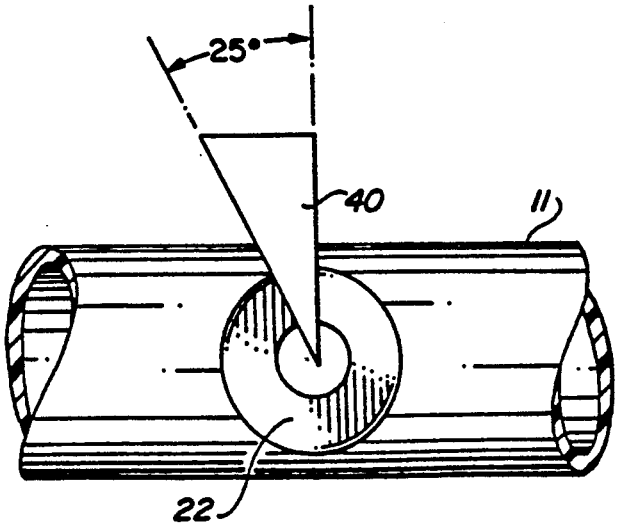
FIG. 5 is an enlarged fragmentary view showing the formation of apertures in the tubing.

FIG. 5 illustrates the construction of the perforations 22 along the tubing 11. .The same are preferably made in the outer wall of standard tubing in the form of conical-shaped apertures 22 that converge outwardly at an approximately 25° pitch. For standard ⅛ inch OD polyethylene tubing, with an outside diameter of 0.125 inches and an inside diameter of 0.063 inches, the apertures 22 are formed with a 0.063 inch diameter inner opening and a 0.125 inch diameter outer opening, preferably using a diamond tipped razor blade 40 of triangular shape that contacts the tubing and rotates in a circle about a vertical axis to create a perforation 22 as the tubing is brought to a momentary halt after exiting from the extruder. The finished product is then rolled into thousand foot, or so, lengths onto rolls for subsequent cutting at the job site.

As shown schematically in FIG. 1, once the tubing lengths 11 and receptacles 20 are installed for the various zones of coverage, the system can be serviced on a regular basis by a certified pest control technician who injects measured amounts of a pesticide propellant into the exposed open ends 27 of the lengths 11 at the receptacles 22. The preferred propellant includes an expanding agent that permits it to be injected into the tubing and then expand as it leaves the perforations 22 (see the release of chemical depicted in FIG. 2).

Suitable materials utilizable with the present system include conventional crack and crevice aerosols, foggers and injection chemicals, such as those available commercially from Whitmire Research Laboratories, St. Louis, MO, and marketed under the trade names PT 110 TM Resmethrin aerosol generator; PT 565 TM Pyrethrum insect fogger; PT 550 TM Resmethrin insect fogger; PT 500 TM Activated Pyrethrum insect fogger; PT 3-6-10 TM Aero-Cide insect fogger; PT 280 TM Orthene TM acephate insecticide; PT 270 TM Dursban TM injection pesticide; PT 260 TM Diazinon TM injection pesticide; and PT 250 TM Baygon TM injection pesticide. The micro-encapsulated pesticide is propelled by use of a pressurized canister or similar EPA approved container 41 (FIG. 1) having a nipple 42 which fits within the exposed end 27 of a length of tubing 11 at a receptacle terminal 20.

Figure 6:
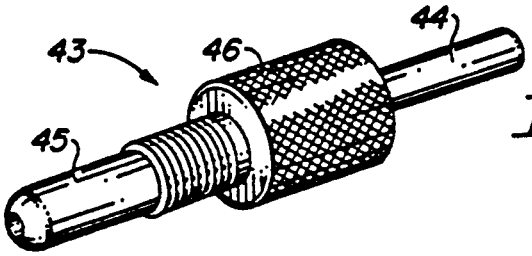
FIG. 6 is an enlarged view showing a nozzle adapter for application of chemical in the system.

FIG. 6 shows a novel adapter fitting 43 having a hollow nipple stem 44 at one end that fits into tubing 11 and a threaded pipe 45 at the other end that mounts into the standard nozzle of a commercially prepackaged pressurized pesticide container. A central larger diameter knurled section 46 intermediate the two ends provides a gripping surface for hand attachment.

Pesticide of a particular pressure is introduced into tubing 11 for a prespecified length of time to give the controlled amount of discharge through the tubing 11 and out the perforations 22 (see FIG. 2) into the building concealed cavities. At 180 PSI, for example, a 7 second spray would be sufficient for a 40 to 60 foot length of tubing, with 25° conical perforations at 12 inch intervals, to dispense the required measured amount of pesticide expanding many, many times its volume.

To extend greater distances from a particular receptacle while maintaining substantially the same pesticide release characteristics, lengths of unperforated tubing can be added to the ends of the perforated tubing lengths that connect to the receptacle. It has been satisfactorily demonstrated, for example, that 40 foot lengths of unperforated tubing can be connected to 40 to 60 foot lengths of perforated tubing without marked degradation of. persticide release characteristics. The lengths of perforated and unperforated tubing may be connected, for example, using commercially available connectors for air and fluid lines in hospitals and such, like the LeGree ⅛ inch tubing connector.

A preferred injection nozzle for use with the above-described freon based propellants is the Whitmire Trigun which includes connections for two chemical propellants and a selector for choosing expulsion of the first chemical only, the second chemical only, or both chemicals simultaneously. For the inventive system, the pesticide tank is connected into one chemical channel and the cleansing gas tank (i.e. nitrogen tank) is connected into the other channel. The two tanks are advantageously joined rigidly together for servicing convenience.

This periodic insertion of pesticide at the receptable terminals maintains a substantial control of pests within all wall cavities, while minimizing the deterioration of the chemicals due to exposure to ultra violet light and the risk of contact with people and animals or their immediate surroundings. After injecting the pesticide, a cleansing of the tubing is performed by injecting 10 seconds of nitrogen gas—eliminating all residue chemical left inside the tubing and preparing it for the next injection of chemical treatment.

The apparatus and method of the present invention provides an improved integrated pest control system easily installed at the time of construction by a builder with no requirement for blueprint changes to be made. The only change in the production schedule is that the system installer is called at the time of electrical inspection, with most installations taking only a few hours. The flexible tubing is rapidly threaded through the building framework. No valve or other similar mechanisms need be installed. Such an installation is an attractive as a benefit for potential homebuyers.

The invention permits measured amounts of EPA approved standard pesticides to be sprayed inside the walls and into otherwise inaccessible areas on a periodic basis to provide a lasting pest control barrier. Pre-prepared materials require no chemical mixing. There is better protection over conventional crack and crevice pest control application because bugs are reached where they hide. There is no ultra violet light inside the walls to dissipate the chemical residue, therefore less treatment is required for the same effect. The maintenance of chemicals inside the walls is preferred over contact treatment of exposed surfaces because of reduced hazard to children and pets. With outside service boxes, the homeowner need not be home to get inside pest control service. Because the chemicals stay within the walls there is less odor and there is no wall, baseboard, carpet, drapery or furniture staining. Running the tubing behind kitchen and bath cabinetry permits the application of chemicals to those areas without the need to empty shelves or closets. By treating areas normally used as accessways by the pests, transfer of pests from room to room and from exterior to interior walls is prevented.

Those skilled in the art will appreciate that the preferred embodiments of the invention described above are just examples of how the invention can be implemented, and that various substitutions and modifications may be made therein without departing from the spirit and scope of the invention as defined by the claims below.

What is claimed is:

1. A gas or liquid distribution system in a building for the control of pests in the building comprising:

tube means disposed in the walls of a building and having a plurality of flexible tubes, each tube having a plurality of openings along the side thereof in one open portion thereof and each tube passing into a predetermined building zone;

a control distribution box attached to a building wall and having a panel therein having a plurality of openings passing therethrough and having the open end of each said flexible tube attached to said panel through one said opening therein; and a plurality of tube end connectors for connecting each flexible tube end to said panel in said control distribution box, each said connector extending into one said panel opening and holding one said flexible tube open end thereto whereby injecting a pest control gas or liquid into an opening in said panel and tube open end will distribute gas or liquid to one zone of a building.

2. A gas or liquid distribution system in a building for the control of pests in the building in accordance with claim 1 in which each said pipe has an injection end and a distribution end and said injection end has solid walls and said distribution end has said plurality of openings therein.

* * * * *